US005317547A

United States Patent [19]

Oishi

[11] Patent Number: 5,317,547

[45] Date of Patent: May 31, 1994

[54] TIME RECORDER

[75] Inventor: Katsumi Oishi, Tokyo, Japan

[73] Assignee: Seikosha Co., Ltd., Tokyo, Japan

[21] Appl. No.: 956,528

[22] Filed: Oct. 5, 1992

[30] Foreign Application Priority Data

Oct. 16, 1991 [JP] Japan ..... 3-267692

[51] Int. Cl.[5] ..... G04B 47/00; G07C 1/14

[52] U.S. Cl. ..... 368/10; 368/107; 346/20; 346/82

[58] Field of Search ..... 368/9, 10, 21, 28, 107-113; 235/377; 346/82-86, 134

[56] References Cited

U.S. PATENT DOCUMENTS 4,011,434 3/1977 Hockler ..... 235/61.9
4,044,545 8/1977 Shimizu ..... 368/21
4,063,071 12/1977 Willmann et al. ..... 235/93 T
4,255,803 3/1981 Sekine ..... 368/72
4,270,043 5/1981 Baxter et al. ..... 235/419
4,333,085 6/1982 Witts ..... 346/76 PH
4,494,127 1/1985 King ..... 346/82
4,506,274 3/1985 Coe ..... 346/82
4,884,253 11/1989 Koyabu et al. ..... 368/10

*Primary Examiner*—Vit W. Miska
*Attorney, Agent, or Firm*—Jordan and Hamburg

[57] ABSTRACT

When a time card is inserted in a time recorder, for daily flextime, and selection is made of a work starting time column using a printing column selection key, the current time is printed onto a specific location of the work starting time column of the card. The printer time may be a work starting time rounded off in any desired manner. The standard number of work hours is stored in a memory circuit and any break times are added to the standard number to obtain an anticipated work ending time. The anticipated work ending time is displayed on a display unit and/or printed on the card.

8 Claims, 4 Drawing Sheets

TIME RECORDER

FIELD OF THE INVENTION

The present invention relates to a time recorder for use with flextime.

BACKGROUND OF THE INVENTION

Conventional time recorders exist which print the starting and work ending times, calculate the total of the working hours and overtime hours for each day, and have prestored starting and work ending times. Based on these stored times, times that are later than normal work starting times and earlier than normal work ending times are printed in separate colors.

When a time recorder of the kind described above is used at companies which adopt a flextime in which the actual working hours in a day are fixed, but in which the work starting and ending times are not fixed, it is necessary to perform the troublesome verification of the work ending time by adding the fixed working hours and resting hours for a day to the printed work starting time.

SUMMARY OF THE INVENTION

It is accordingly an object of the present invention to eliminate the difficulty of calculating work ending times corresponding to work starting times, when daily flextime is adopted.

According to the present invention, the above object is achieved by the provision of control means for displaying, on a display means, of a working ending time corresponding to a work starting time.

Further, the above mentioned object is also achieved by the provision of printing means for printing the current time or the work starting time, rounded off in a desired manner, onto a specific location of the printing column selected by a selection means, as well as for printing the work ending time corresponding to the work starting time.

BRIEF DESCRIPTION OF THE DRAWINGS

In order that the invention may be more clearly understood, it will now be disclosed in greater detail with reference to the accompanying drawings, wherein.

DESCRIPTION OF THE PREFERRED EMBODIMENTS

Figure 1:
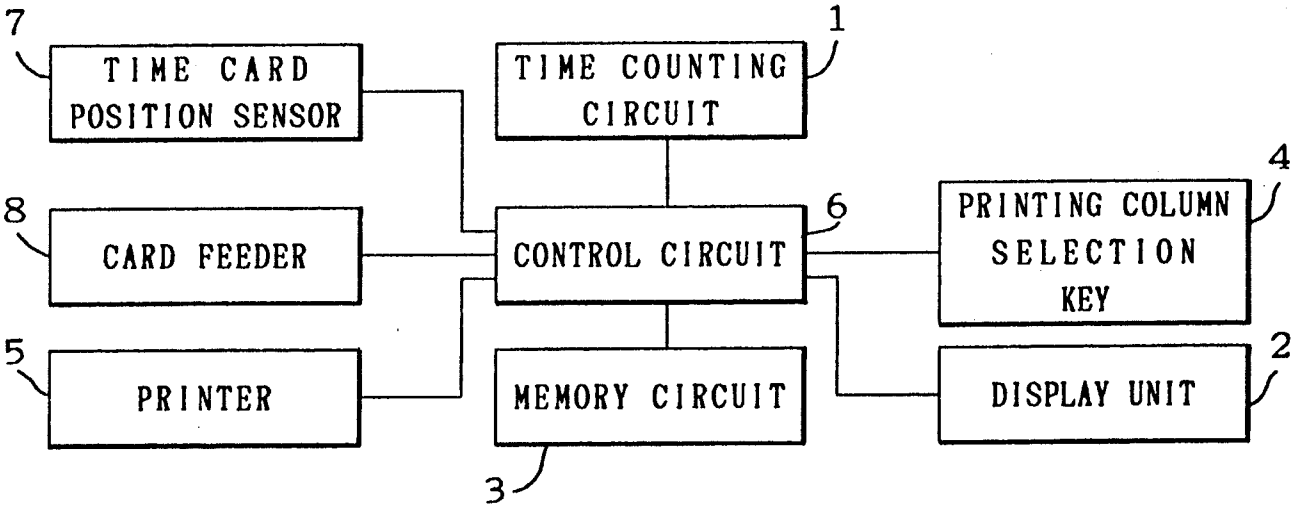
FIG. 1 is a block circuit diagram of an embodiment of the present invention.

In FIG. 1, reference numeral 1 denotes time counting means comprising a time counting circuit for counting current time. Reference numeral 2 denotes display means comprised of a display unit such as an LCD, etc. for displaying time information. Memory circuit 3 is comprised of, for example, a RAM, etc., for recording determined times such as standard working time, break time, etc. Selection means 4 is comprised of a printing column selection key. Printing means 5 is comprised of a printer. Control means 6 is comprised of a control circuit such s a CPU, ROM, RAM, etc. A time card position sensor 7 is provided for sensing the position of the inserted time card according to, for example, punch holes provided on the time card. A card feeder 8 comprises, for example, a motor for feeding the inserted card.

Figure 2:
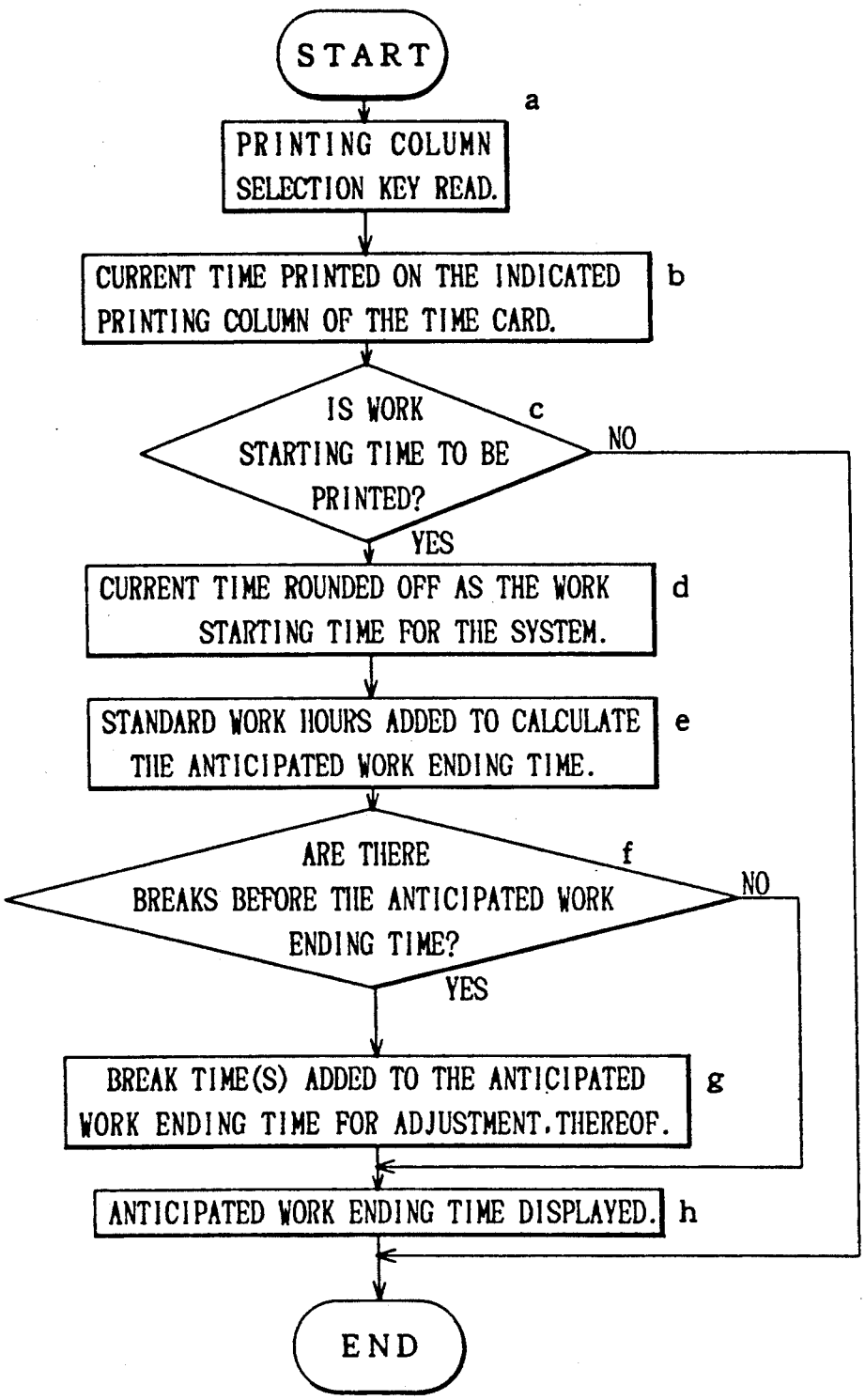
FIG. 2 is a flow chart explaining the operation of the embodiment according to FIG. 1.

An explanation will now be given of the operation of the present invention, with reference to FIG. 2. This explanation assumes that the first column of the time card is the work starting time column.

When the time card is inserted in the recorder and a printing column is selected using the printing column selection key 4, the selected printing column is stored in the RAM of the control circuit 6 (step a). Next, the selected printing column of the time card is set in the printer 5 by the time card position sensor 7 and the card feeder 8, and the printer 5 prints the current time (step b). If the first column, i.e., the work starting time column is selected using the printing column selection key 4 (step c), the control circuit 6 adds a determined time to the printed time, setting it as the work starting time for the system (step d). For example, if the work starting time for the system is rounded to the nearest next 15 minutes, then when the work starting time is printer as 9:17, the work starting time for the system is 9:30. Next, a standard number of working hours stored in the memory circuit 3 is added to the above mentioned work starting time for the system, resulting in an anticipated work ending time (step e). If there are any break times before the anticipated work ending time (step f), then these break times which are also stored in the memory circuit 3 are added to the anticipated work ending time, thus adjusting the anticipated work ending time (step g), and this adjusted anticipated work ending time is displayed on the display unit 2 (step h). If, on the other hand, there are no break times before the anticipated work ending time (step f), the anticipated work ending time already calculated is displayed on the display unit 2 (step h).

For example, if the standard number of working hours is 7 hours, the break period is 1 hour, and the work starting time is 9:41, then the standard number of work hours, i.e., 7 hours and the break period, i.e., 1 hour are added to the work starting time for the system, i.e., 9:45 for a time of 17:45 which is displayed on the display unit 2 as the anticipated work ending time. The display unit is not limited to an LCD, since the same effect may be achieved using a 7-segment LED or other conventional display device.

Further, by additionally preparing multiple work starting time columns on the time card, as well as storing multiple standard numbers of work hours in the memory circuit 3, then even when the timer is utilized by employees whose standard numbers of work hours differ, it is possible to display the anticipated work ending time for each separate standard number of work hours.

For example, assume that the first and second printing columns are work starting time columns, and the first column is used by a full-time employee whose standard number of work hours is 8 hours, while the second column is used by a part-time employee whose standard number of work hours is 7 hours. When the standard number of work hours are stored in the memory circuit 3 as 8 hours and 7 hours, respectively, then upon selecting the first work starting time column using the printing column selection key 4, 8 hours, which is stored in the memory circuit 3, is added to the work starting time for the system, and this sum is displayed on the display unit 2 as the anticipated work ending time. Likewise, upon selecting the second work starting time column using the printing column selection key 4, 7 hours, which is stored in the memory circuit 3, is added to the work starting time for the system, and this sum is displayed on the display unit 2 as the anticipated work ending time.

A classification of standard working hours may be included on the time card, and inputting may be done from a keypad (not shown) to select a standard number of working hours, so that it is possible to display an exact anticipated work ending time even when operated by employees whose standard number of working hours differ from each other.

In the embodiment described above, the anticipated work ending time was displayed on the display unit, but an explanation will now be made with reference to FIG. 3, of an embodiment in which the anticipated work ending time is printed onto a determined printing column of the time card.

Figure 3:
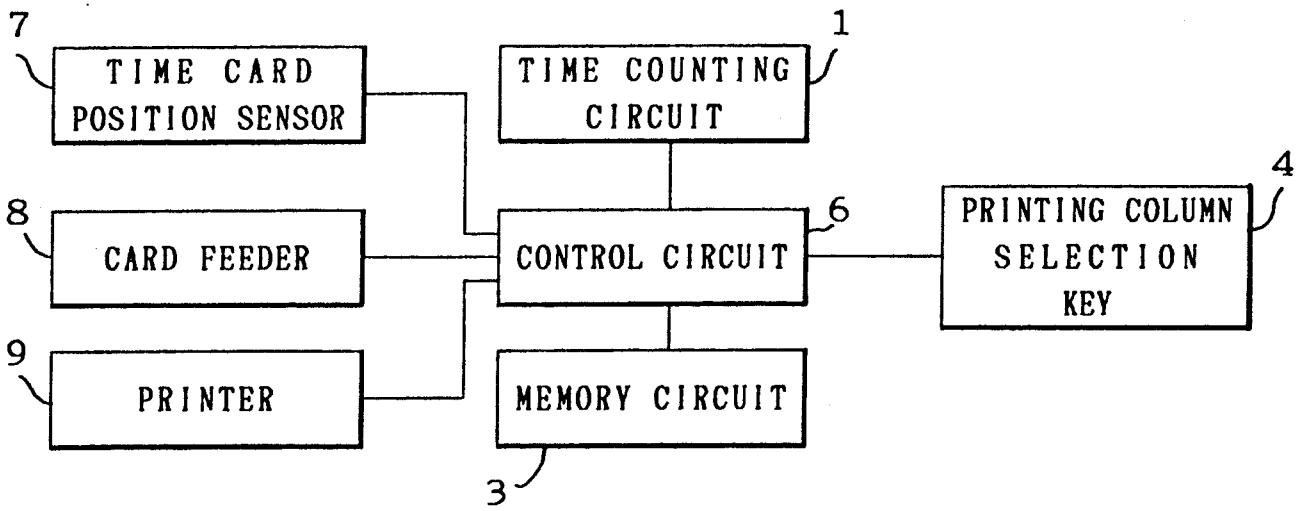
FIG. 3 is a block circuit diagram of another embodiment of the present invention.

In FIG. 3, printing means 9 is comprised of a printer for printing the current time and the anticipated work ending time. The numerals identical to those in FIG. 1 identify identical parts.

Figure 4:
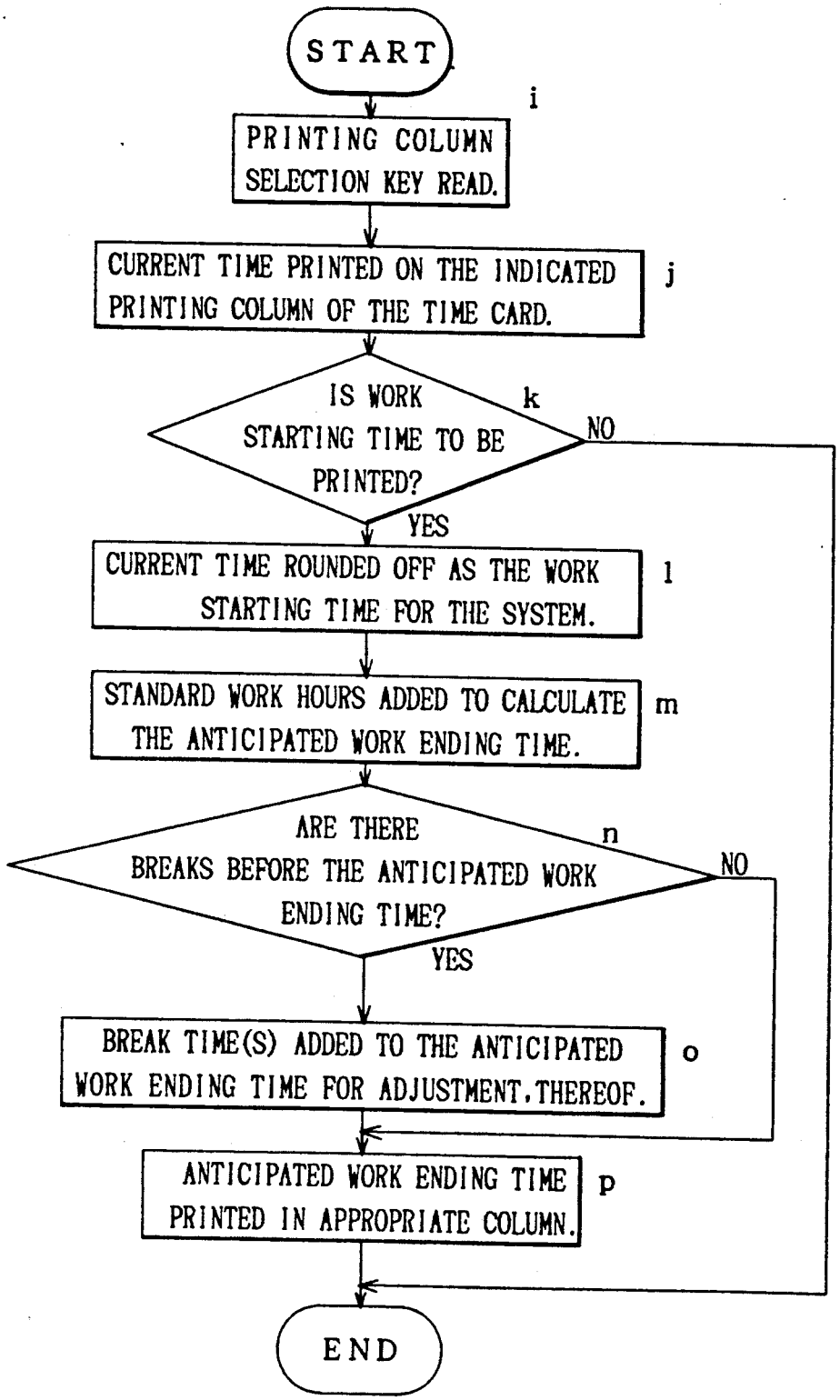
FIG. 4 is a flow chart explaining operation of the embodiment according to FIG. 3.

An explanation will now be made regarding the operation, with reference to FIG. 4. Assume that the first column of the time card is the work starting time column, and the second column is the anticipated work ending time column.

When the time card is inserted in the recorder and the work starting time column is selected using the printing column selection key 4, the current time is printed onto a specific location of the work starting time column in the same manner as described in the previous example. This printed time is the work starting time for the system, and the standard working hours stored in the memory circuit 3 plus any break times are added to this time to calculate the anticipated work ending time (steps i, j, k, l, m, n, o). Then the anticipated work ending time thus calculated is printed onto a specific location of the second column, i.e., the anticipated work ending time column (step p).

In this embodiment, as in the previous one, a classification of standard working hours may be included with multiple work starting time columns on the time card, so that a keypad may be used to select a standard number of working hours, to adapt to cases when operation is done by employees whose standard number of working hours differ from each other.

In each of the embodiments described above, the time printed onto the work starting time column was the current time, but the same effect is achieved even when printing a work starting time which is rounded off, according to the system, onto the work starting time column.

According to the present invention, a time recorder may include control means for displaying on display means a work ending time corresponding to a work starting time, eliminating the need for the employee to make a troublesome calculation of the work ending time corresponding to the work starting time, in cases where a daily flextime is adopted, and making it possible to display the exact anticipated work ending time.

Furthermore, the recorder may print the current time or the time rounded off according to the system, onto a specific location of a printing column selected according to a selecting means as the work starting time, and it may be provided with a printing means for printing the work ending time corresponding to the said work starting time, thereby eliminating any need to make a troublesome calculation of the work ending time corresponding to the work starting time, and making it possible to display the exact anticipated work ending time. This printed information is also useful in order to confirm the anticipated work ending time at times other than at the beginning of the day.

Although the present invention has been fully described by way of example with reference to the accompanying drawings, it is to be understood that various changes and modifications will be apparent to those skilled in the art. Therefore, unless such changes and modifications depart from the scope of the invention, they should be construed as being included therein.

What I claim is:

1. A time recorder comprising a time counter for counting current time, means for sensing a time card, a display means, and control means for controlling the display means to display a time, as a work ending time, corresponding to a rounded off time corresponding to a time sensing the time card plus a predetermined time period.

2. A time recorder comprising a time counter, means for initiating counting by said time counter, a display means and control means for controlling the display means to display a time corresponding to the time of initiation of said counting plus a predetermined time period:

said means for initiating counting by said counter comprising means for sensing a time card, and said means for controlling said display comprising a memory storing data corresponding to a predetermined time period and means for adding said predetermined time period from said memory to the time of initiation of counting by said counter for display on said display means.

3. In a work time recorder including means for sensing a time card having a plurality of printing columns, the time card having a first column for receiving a work starting time, and means for printing an output onto a specific column of the time card in response to insertion of said time card in said recorder, the improvement comprising:

time counting means;

a display for displaying time information;

selecting means for selecting a column of said time card;

means responsive to the time count of said counting means for controlling said printing means to print a work starting time corresponding to a current time on the column of said time card selected by said selector; and means for controlling said display means to display a work ending time, said work ending time being the sum of said work starting time and a predetermined time period.

4. The work time recorder according to claim 3, wherein said means for controlling said printing means to print a work starting time comprises means for controlling said printing means to print a rounded off time corresponding to said current time.

5. The work time recorder according to claim 3, wherein said means for controlling comprises a memory storing a time corresponding to a number of working hours and a time corresponding to another time period, said predetermined time period being the sum of said number of working hours and said another time period.

6. In a work time recorder including means for sensing a time card having a plurality of printing columns, the time card having a first column for receiving a work starting time, and means for printing an output onto a specific column of the time card in response to insertion of said time card in said recorder, the improvement comprising:

time counting means;

selecting means for selecting a column of said time card;

means responsive to the time count of said counting means for controlling said printing means to print a work starting time corresponding to a current time on the column of said time card selected by said selector; and means for controlling said printing means to print a work ending time on said card, said work ending time being the sum of said work starting time and a predetermined time period.

7. The work time recorder of claim 6, wherein said means for controlling said printing means to print a work starting time comprises means for controlling said printing means to print a rounded off time corresponding to said current time.

8. The work time recorder of claim 6, wherein said means for controlling comprises a memory storing a time corresponding to a number of working hours and a time corresponding to another time period, said predetermined time period being the sum of said number of working hours and said another time period.

* * * * *